US005961170A

United States Patent [19]

Baumann et al.

[11] Patent Number: 5,961,170

[45] Date of Patent: Oct. 5, 1999

[54] METHOD AND APPARATUS FOR TRANSPORTING LOADS

[75] Inventors: Andreas Baumann; Burkhard Mende, both of Essen, Germany

[73] Assignee: Krupp Fördertechnik GmbH, Germany

[21] Appl. No.: 08/950,260

[22] Filed: Oct. 14, 1997

[30] Foreign Application Priority Data

Oct. 12, 1996 [DE] Germany ..... 196 42 197

[51] Int. Cl.[6] ..... B66C 1/28

[52] U.S. Cl. ..... 294/81.51; 294/67.31

[58] Field of Search ..... 294/81.1, 81.2, 294/81.5, 81.51, 81.54, 81.6, 81.61, 67.3, 67.31

[56] References Cited

U.S. PATENT DOCUMENTS

| | | | |
|---|---|---|---|
| 3,243,224 | 3/1966 | Gutridge | 294/81.54 |
| 3,458,229 | 7/1969 | Nagy et al. | 294/81.2 |
| 3,558,176 | 1/1971 | Fathauer et al. | 294/81.51 |
| 3,602,375 | 8/1971 | Martinson | 294/81.54 |
| 3,880,456 | 4/1975 | DeRoshia | 294/81.51 |

FOREIGN PATENT DOCUMENTS

| | | |
|---|---|---|
| 1073192 | 6/1967 | United Kingdom . |
| 1254966 | 11/1971 | United Kingdom . |

OTHER PUBLICATIONS

Glasers Annals, Journal for Traffic Engineering, 93 (1969), No. 10, p. 308.

German Hoisting and Conveying Technology, special issue for the Hanover Trade Fair 1969, pp. 181 to 184.

*Primary Examiner*—Dean Kramer

*Attorney, Agent, or Firm*—Venable; George H. Spencer; Robert Kinberg

[57] ABSTRACT

A method and apparatus for transporting loads includes a gripper pliers including a pair of pivotable gripper arms, each of which has a gripper claw. A positioning element is operatively coupled to the pair of gripper arms for pivoting the gripper arms in a pivoting plane and displacing the gripper arms in a gripping direction transversely of the pivoting plane into a position so that the gripper claws can engage connecting regions of the load. At least one of the gripper arms includes a transverse guide for fixing it against further pivoting and back-pivoting within the pivoting plane after the gripper arm has pivoted into an operating position for being displaced in the gripping direction.

16 Claims, 6 Drawing Sheets

METHOD AND APPARATUS FOR TRANSPORTING LOADS

CROSS-REFERENCE TO RELATED APPLICATIONS

This application claims the right of priority of application No. 196 42 197.7 filed in Germany on Oct. 12, 1996, the disclosure of which is incorporated herein by reference.

BACKGROUND OF THE INVENTION

The invention relates to a method for transporting loads in which gripper claws of pivoting gripper arms engage predefined connecting regions of the load and, prior to engaging the load, are pivoted out of an initial position into an operating position, and, after the gripper arms have been pivoted into the operating position, gripper pliers are positioned transversely for engaging connecting regions of the load.

The invention further relates to an apparatus for transporting loads, which has gripper claws that are held by pivoting gripper arms, and in which the gripper arms have a plier guide that extends essentially transversely with respect to the pivoting direction of the arms. Gripper pliers can be positioned along this guide for engaging connecting regions of the load.

Apparatuses of this type are configured as load-receiving means, and can be used to grip containers, interchangeable containers, or semitrailers. The apparatus is typically positioned for use with the aid of cranes. The apparatus is usually mounted on "spreaders." Spreaders are provided with twist locks that can be inserted into corner fittings of containers and permit a form-fitting latching with the container. The head girders having twist locks can be telescopic.

In the present case, however, a primary feature is a spreader embodiment in which two folding and pivotable gripper-plier pairs are used to grip interchangeable containers or semitrailers. The gripper pliers are in lateral contact with gripper pockets attached to the loading units (i.e. the containers or semitrailers). The loading units are supported on gripper claws of the gripper pliers, and are fixed solely by friction in the longitudinal direction of the container.

Spreaders having gripper pliers are used in different environments, for example in the area of rail-bound transport of goods in crane facilities of transfer terminals. The gripper pliers are typically seated in pendulum fashion in the operating position, and can pivot out in opposite directions by about±10 from the operating position . Under the effect of horizontal accelerations, the cargo can consequently swing out in both the transport direction and transversely thereto, so horizontal accelerations of up to about 0.5 m/sec$^2$ can be tolerated without problems.

The pendulum movements resulting from this swinging out, however, impede automatic operation of the crane, both during acceleration and slowing. The effect of wind, particularly wind gusts, can cause deviations in position. Likewise, swinging may also occur due to horizontal accelerations. This type of deviation from the desired position can only be compensated by complicated control algorithms that increase the outlay for regulating technology and machinery, increase the time requirement for positioning procedures and reduce the operational capacity due to the necessary settling times.

The known apparatuses and methods are inadequately suited for reliably preventing off-centering of loading units relative to the gripper device during gripper-plier operation, because the forces acting in the longitudinal direction can only be introduced into the gripper arms by the above mentioned frictional connection. One problem that may occur is that the center of gravity of the loading units can be off-center. Under these conditions, different frictional forces occur in the region of the gripper pliers, so the supported weight is asymmetrically distributed onto the gripper pliers as a function of the fixed position of the center of gravity.

SUMMARY OF THE INVENTION

It is an object of the present invention to improve a method of the type mentioned at the outset such that each gripper-arm pair is fixed in two possible directions of acceleration.

In accordance with the invention, this object is accomplished in that, after attaining the operating position, at least one of the gripper arms is fixed against both further pivoting and back-pivoting.

It is a further object of the present invention to construct an apparatus of the type mentioned at the outset so as to facilitate its use in automated operation.

In accordance with the invention, this object is accomplished in that the gripper arm is provided with at least one transverse guide that fixes the gripper arm against both further pivoting and back-pivoting within a gripper-arm pivoting plane after the arm has been pivoted into an operating position.

Self-movement of the load relative to the gripper arms and oscillating movements of the gripper arms are reliably avoided by the proposed method and with the aid of the proposed apparatus. Thus, highly-precise positioning can be effected without costly control procedures, and a high load-transport throughput rate can be attained at low cost.

A typical application provides that at least two gripper arms are fixed against both further pivoting and back-pivoting.

A special feature that reliably avoids unintentional compensating movements is the fixing of the gripper arm with a frictional connection.

A mechanically simple construction involves the fixing of at least one of the gripper arms during a transverse displacement of the gripper claws in the gripping direction.

In accordance with another embodiment of the invention, the gripper arm is fixed by being extended behind by a limiting part.

Another embodiment involves fixing the arm by extending it between limiting elements facing one another.

A compromise is reached between high production requirements and simple handling by fixing the arm with structural elements that engage each other with clearance.

A use of simple controls is supported by the fixing of the arms with structural elements without clearance.

BRIEF DESCRIPTION OF THE DRAWINGS

The drawings schematically illustrate embodiments of the invention.

DETAILED DESCRIPTION OF THE INVENTION

Figure 1:
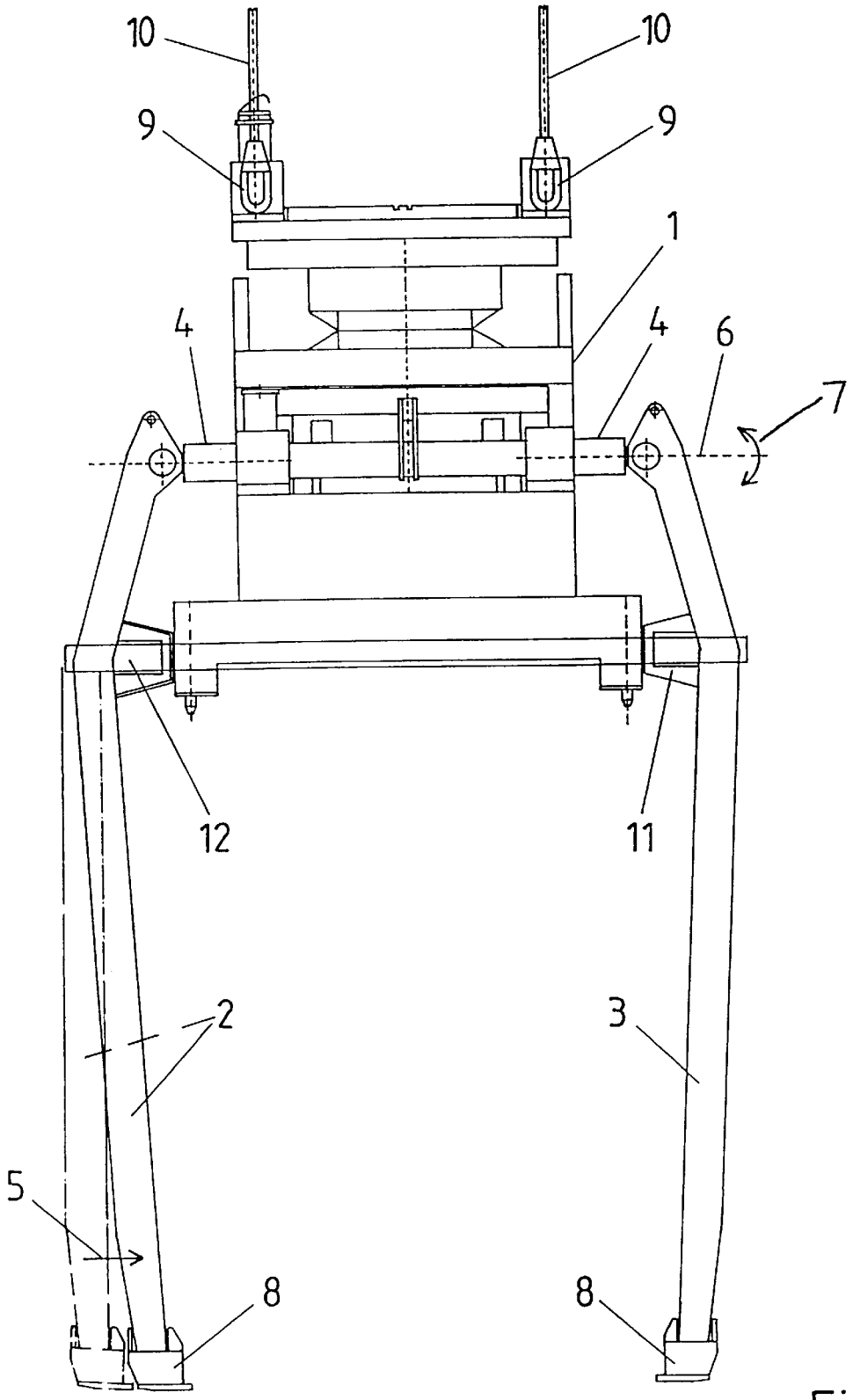
FIG. 1 shows a side view of a spreader in which gripper arms are pivoted down, with a gripper plier being formed by two gripper arms.

Referring to FIG. 1, there is shown an embodiment of an apparatus according to the invention in which pivotable gripper arms 2, 3 are held by a frame 1. Gripper arms 2, 3 are connected with positioning elements 4, which are preferably positioning cylinders, for facilitating the positioning of gripper arms 2, 3 in a gripping direction 5, between a working or operating position and a pivoting position (shown by the dashed line).

Gripper arms 2, 3 are also pivotable, relative to an axis of rotation 6, in directions of rotation 7. The axis of rotation 6 can extend symmetrically with respect to a center line of setting elements 4.

Gripper arms 2, 3 are provided with gripper claws 8 in a region of their expansions facing away from frame 1. Frame 1 has a coupling element 9 for connection with cable pulls 10 of a crane, not shown. Two gripper arms 2, 3 form a gripper plier.

To guide gripper arms 2, 3 during positioning in gripping direction 5, transverse guides 11 are disposed in a lower region of frame 1 with respect to the vertical direction. Positioning elements for positioning gripper arms 2, 3 can also engage gripper arms 2, 3 in the vicinity of transverse guides 11. To limit a rotational positioning of gripper arms 2, 3 in the direction of rotation 7, detents 12 are disposed as stop girders inside transverse guide 11.

Figure 2:
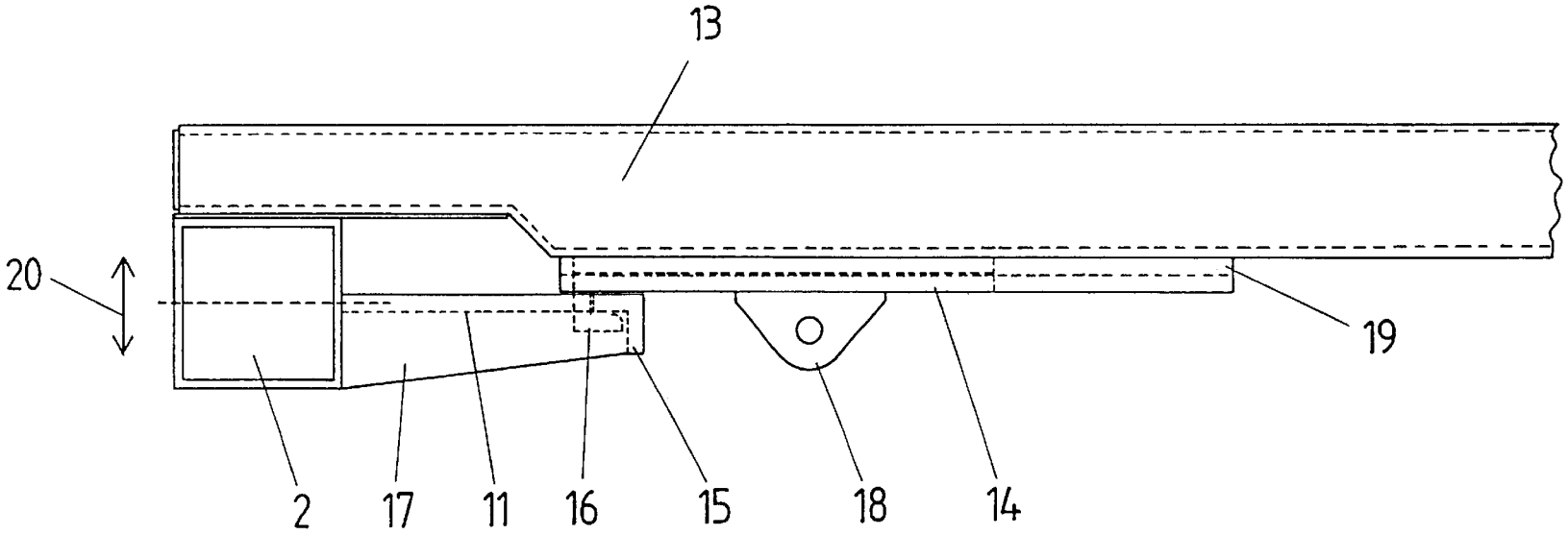
FIG. 2 shows an enlarged, partial plan view of the apparatus of FIG. 1 in an embodiment that includes an arm detent formed by detent pawls that engage one another.

FIG. 2 is a plan view which shows an enlarged partial representation of the apparatus in the region surrounding transverse guide 11. Transverse guide 11 extends essentially parallel to a stop girder 13, which is connected to a guide element 14. In the region of its expansion facing away from gripper arm 2, transverse guide 11 terminates into an angled detent element 15. Stop girder 13 is provided with a pawl 16, which is likewise angled. Between gripper arm 2 and pawl 16, transverse guide 11 is configured as a slide.

To ensure adequate stability, it is possible to provide transverse guide 11 with a reinforcing element 17. For example, reinforcing element 17 and the region of transverse guide 11 configured as a slide can be plate-shaped and disposed essentially at an angle to one another. Gripper arm 2 can be positioned in that a positioning element, for example a hydraulic cylinder, engages a tab 18 disposed at guide element 14.

Pawl 16 is positioned by an adjustment to guide element 14 relative to a holding rail 19, and gripper arm 2 is simultaneously positioned by the frictional engagement with detent element 15. After pawl 16 has extended into detent element 15, cooperation with stop girder 13 effects the fixing of gripper arm 2 against movements in a transport direction 20. Arm detent 12 is thus configured by the cooperation of pawl 16, detent element 15 and stop girder 13.

Figure 3:
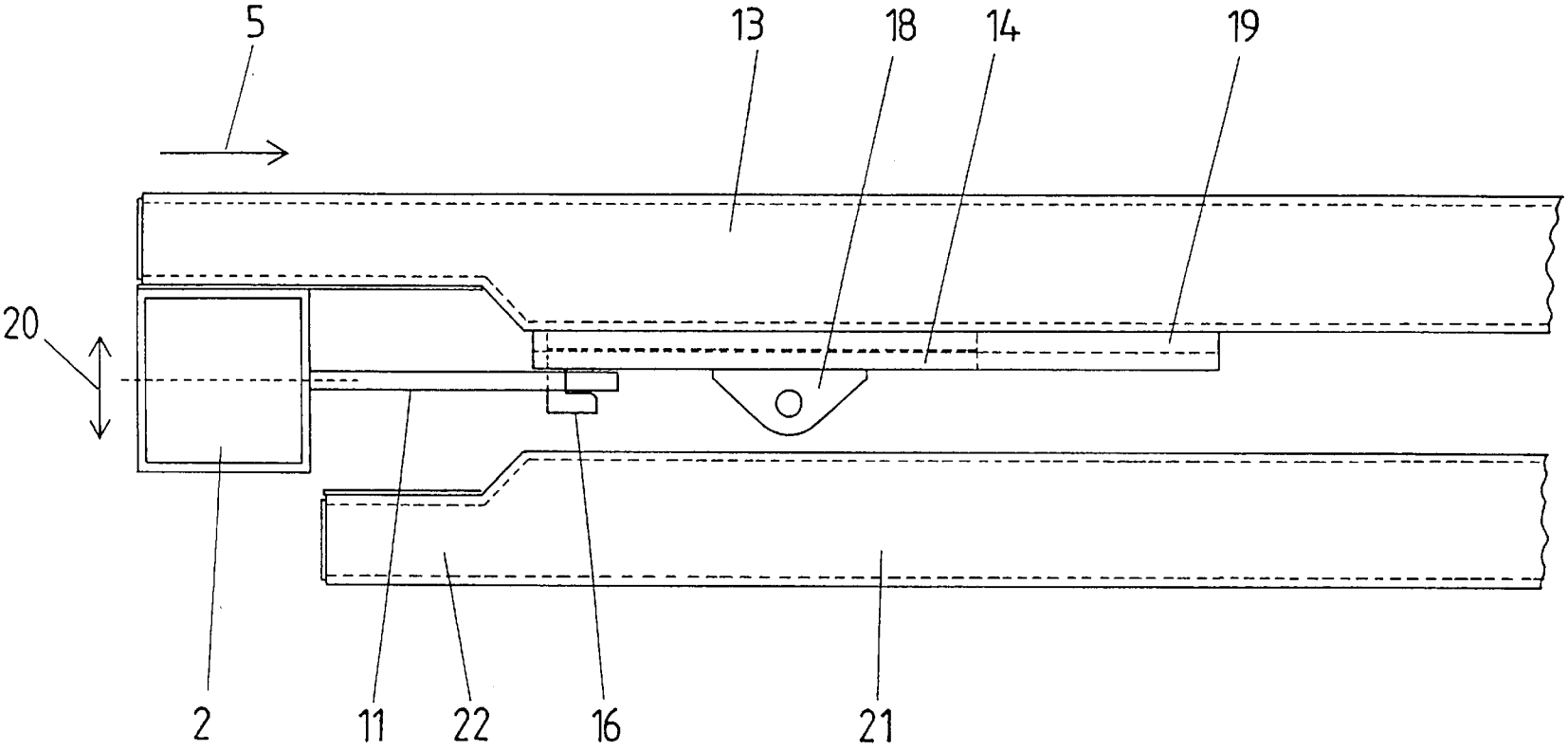
FIG. 3 is a similar view as in FIG. 2 but of a different embodiment, in which the arm detent is formed by two parallel stop girders.

In the embodiment shown in FIG. 3, a detent girder 21 extends parallel to stop girder 13. In accordance with this embodiment of the invention, detent girder 21 is provided with a longitudinal expansion, relative to stop girder 13, that is smaller than the longitudinal expansion of stop girder 13 by about the diameter of gripper arm 2. It is thus possible for gripper arm 2 to pivot past detent girder 21, toward stop girder 13, and for a pivotable fixing of gripper arm 2 to first be effected in transport direction 20 during a displacement of gripper arm 2 in gripping direction 5. Gripper arm 2 is therefore stopped automatically when it is positioned in gripping direction 5.

A special feature of the invention is that, in the region of a guide end 22, detent girder 21 is configured essentially mirror-symmetrically with respect to stop girder 13 in the opposite region.

Figure 4:
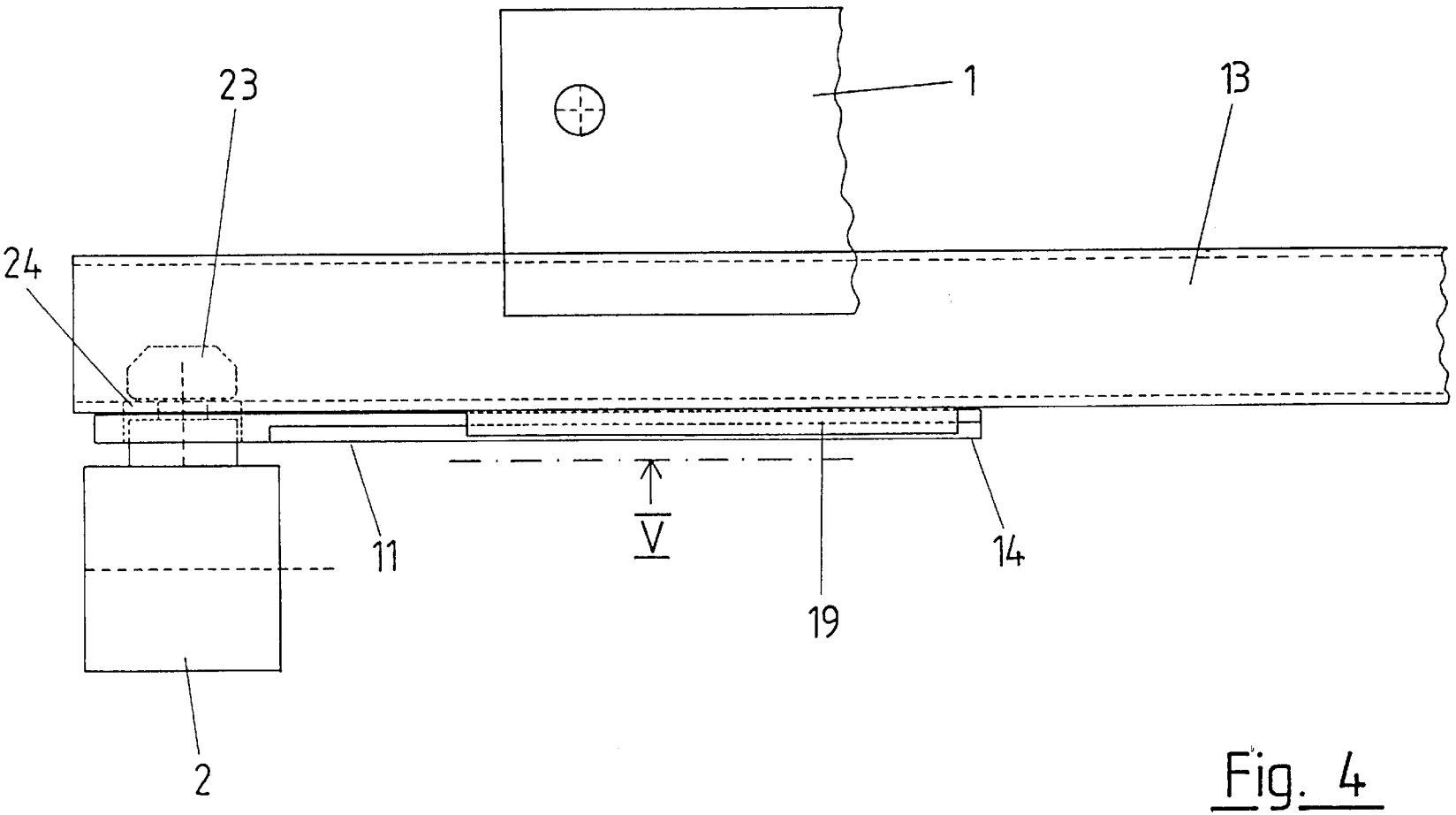
FIG. 4 is also a view similar to that of FIG. 2 but yet of a further embodiment in which the detent device is formed by a latching apparatus.

In the embodiment according to FIG. 4, gripper arm 2 extends with a holding or securing head 23 into a recess 24 of transverse guide 11 configured as a slide.

Figure 5:
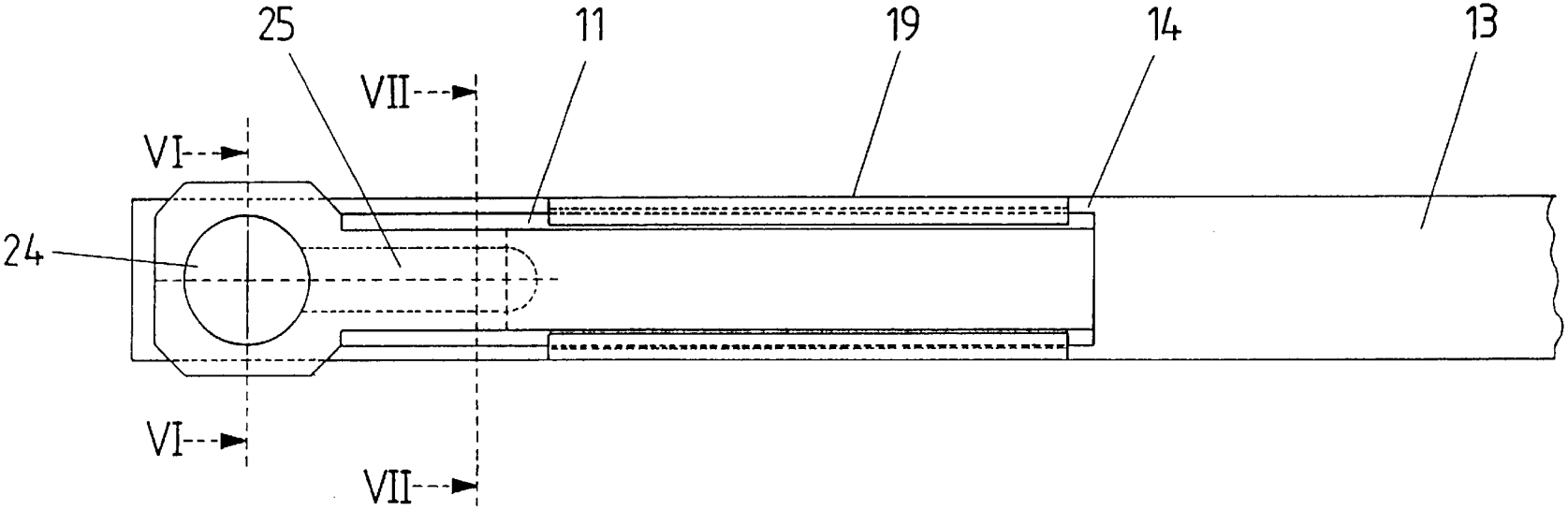
FIG. 5 is a side view in a viewing direction V of the apparatus of FIG. 4 with the gripper arm pivoted back.

From the plan view of FIG. 5, it can be seen that recess 24 terminates into an oblong hole 25 that has a smaller expansion in a transverse direction than the diameter of recess 24.

Figure 6:
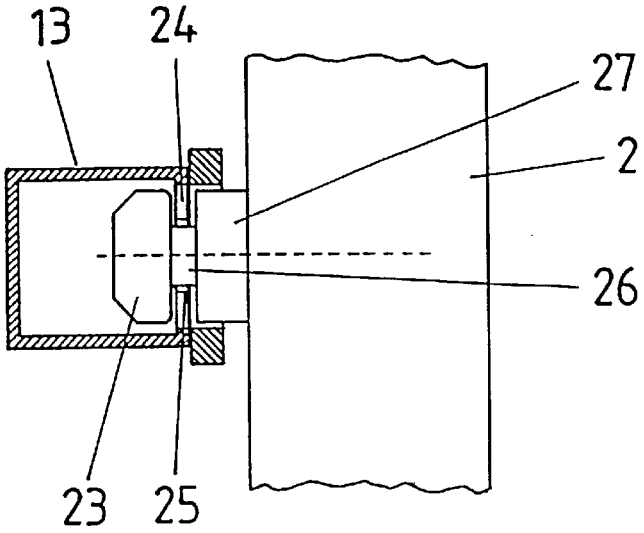
FIG. 6 is a cross-section along line VI—VI in FIG. 5.

From the cross-section in FIG. 6, it can be seen that the diameter of holding head 23 is slightly smaller than the diameter of recess 24. At the same time, the diameter of holding head 23 is larger than the width of oblong hole 25. Holding head 23 is connected to stop girder 13 by a neck 26 and a shoulder part 27. Shoulder part 27 is dimensioned to correspond approximately to the diameter of holding head 23. The diameter of neck 26 is slightly smaller than the width of oblong hole 25. When gripper arm 2 is displaced, neck 26 can travel into oblong hole 25, and holding head 23 extends behind side regions of oblong hole 25. Gripper arm 2 is thus fixed.

Figure 7:
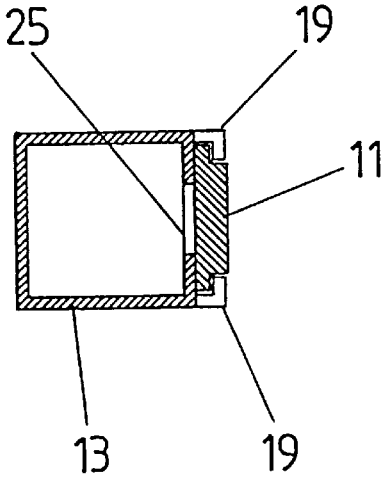
FIG. 7 is a cross-section along line VII—VII in FIG. 5.

The cross-section of FIG. 7 again shows the holding of transverse guide 11 configured as a slide inside holding rail 19, which can be formed by two parallel angled profiles.

The invention has been described in detail with respect to preferred embodiments, and it will know be apparent from the foregoing to those skilled in the art that changes and modifications may be made without departing from the invention in its broader aspects, and the invention, therefore, as defined in the appended claims is intended to cover all such changes and modifications as fall within the true spirit and scope of the invention.

What is claimed is:

1. A method for transporting a load, comprising:

pivoting gripper arms of a gripper pliers in a pivoting direction out of an initial position into an operating position;

fixing at least one of the gripper arms against further pivoting and back-pivoting only after attaining the operating position and during a displacement of the gripper claws in the gripping direction;

subsequently positioning the gripper arms in a gripping direction transverse of the pivoting direction for engaging pre-defined connecting regions of the load with gripper claws of the gripper arms.

2. The method as defined in claim 1, wherein the fixing step includes fixing at least two gripper arms of the gripper pliers against further pivoting and back-pivoting.

3. The method as defined in claim 1, wherein the fixing step includes fixing the gripper arm with a frictional connection.

4. The method as defined in claim 1, wherein the fixing step includes extending the arm behind a de-limiting part.

5. The method as defined claim 1, wherein the fixing step includes latching a coupling element of the arm in a guide element.

6. An apparatus for transporting a load, comprising:

a gripper pliers including a pair of pivotable gripper arms, each gripper arm including a gripper claw; and a positioning element operatively coupled to the pair of gripper arms for pivoting the gripper arms in a pivoting plane and displacing the gripper arms in a gripping direction transversely of the pivoting plane into a position so that the gripper claws can engage connecting regions of the load;

at least one of the gripper arms including a transverse guide for guiding the at least one gripper arm in a direction transverse to the pivoting plane and a detent effective for fixing the at least one gripper arm against further pivoting and back-pivoting within the pivoting plane only after the at least one gripper arm has pivoted into an operating position and during displacement in the gripping direction.

7. The apparatus as defined in claim 6, wherein the detent includes structural elements that engage the transverse guide for fixing the at least one gripper arm against pivoting and back-pivoting.

8. The apparatus as defined in claim 6, wherein the detent includes structural elements that engage the transverse guide in a frictional connection for fixing the at least one gripper arm against pivoting and back-pivoting.

9. The apparatus as defined in claim 6, wherein the detent includes a limiting part behind which the transverse guide extends.

10. The apparatus as defined claim 6, wherein the detent includes a stop girder that has two limiting surfaces extending with spacing from one another, and between which the at least one gripper arm is disposed for displacement in the gripper direction.

11. The apparatus as defined in claim 6, wherein the detent includes a stop girder that has a recess, and the transverse guide includes a holding head that is disposed to be received by the recess in the stop girder.

12. A method for transporting a load, comprising:

pivoting gripper arms of a gripper pliers in a pivoting direction out of an initial position into an operating position;

fixing at least one of the gripper arms against further pivoting and back-pivoting after attaining the operating position by inserting the at least one arm between limiting elements facing one another; and subsequently positioning the gripper arms in a gripping direction transverse of the pivoting direction for engaging pre-defined connecting regions of the load with gripper claws of the gripper arms.

13. The method as defined in claim 12, wherein the fixing step includes fixing at least two gripper arms of the gripper pliers against further pivoting and back-pivoting.

14. The method as defined in claim 12, wherein the fixing step includes fixing the gripper arm with a frictional connection.

15. The method as defined in claim 12, wherein the fixing step includes extending the arm behind a de-limiting part.

16. The method as defined claim 12, wherein the fixing step includes latching a coupling element of the arm in a guide element.

* * * * *